US010067479B2

(12) United States Patent
Yu et al.

(10) Patent No.: US 10,067,479 B2
(45) Date of Patent: Sep. 4, 2018

(54) WEARABLE DEVICE AND FUNCTIONAL MODULE THEREOF

(71) Applicant: COMPAL ELECTRONICS, INC., Taipei (TW)

(72) Inventors: Shih-Hai Yu, Taipei (TW); Sheng-Chiao Peng, Taipei (TW); Shih-Chi Lee, Taipei (TW)

(73) Assignee: COMPAL ELECTRONICS, INC, Taipei (TW)

( * ) Notice: Subject to any disclaimer, the term of this patent is extended or adjusted under 35 U.S.C. 154(b) by 58 days.

(21) Appl. No.: 15/377,108

(22) Filed: Dec. 13, 2016

(65) Prior Publication Data

US 2018/0095430 A1 Apr. 5, 2018

(30) Foreign Application Priority Data

Sep. 30, 2016 (TW) ..... 105131798 A

(51) Int. Cl.
*G04G 17/06* (2006.01)

(52) U.S. Cl.
CPC ..... *G04G 17/06* (2013.01)

(58) Field of Classification Search
CPC ..... G04G 19/00; G04G 17/04; G04G 17/02; G04G 17/00; G04G 17/06; A44C 5/00; A44C 5/08; H01R 13/62; H04M 1/0206
See application file for complete search history.

(56) References Cited

U.S. PATENT DOCUMENTS 4,412,751 A * 11/1983 Jeannet ..... G04G 17/083 368/204
5,872,744 A * 2/1999 Taylor ..... G04G 17/083 224/164
5,889,737 A * 3/1999 Alameh ..... G04C 10/00 368/204
6,854,978 B2 * 2/2005 Noirjean ..... H01Q 1/273 343/718

(Continued)

FOREIGN PATENT DOCUMENTS

CN 1324030 A 11/2001
CN 205054207 U 3/2016
TW 201626950 A 8/2016

*Primary Examiner* — Sean Kayes
(74) *Attorney, Agent, or Firm* — Kirton McConkie; Evan R. Witt

(57) ABSTRACT

A wearable device includes a host and plural functional modules. The host includes a first housing and a controlling unit. The controlling unit includes a first electrical conduction part and a second electrical conduction part. Each functional module is capable of detachable coupling with the host. Every two adjacent functional modules are detachably coupled with each other. Each functional module includes a second housing, a functional circuit unit and a connection unit. The functional circuit unit includes a third electrical conduction part and a fourth electrical conduction part. The connection unit includes a first connection part and a second connection part. The first connection part is connected with the third electrical conduction part. The second connection part is selectively connected with the first electrical conduction part, the second electrical conduction part of the host or the fourth electrical conduction part of the adjacent function module.

9 Claims, 10 Drawing Sheets

(56) References Cited

U.S. PATENT DOCUMENTS 7,618,260 B2 * 11/2009 Daniel ..... A44C 5/0007 24/311
8,467,270 B2 * 6/2013 Gossweiler, III ..... G04G 17/06 345/173
9,122,249 B2 * 9/2015 Lyons ..... G04G 17/083
9,141,086 B1 * 9/2015 Rohrbach ..... G04B 37/1486
9,318,904 B2 * 4/2016 Malladi ..... H02J 7/0042
9,471,102 B2 * 10/2016 Townsend ..... G06F 1/163
9,541,955 B2 * 1/2017 Holtzman ..... G06F 1/1635
9,553,625 B2 * 1/2017 Hatanaka ..... H04B 1/385
9,600,030 B2 * 3/2017 Bailey ..... G06F 1/163
9,693,609 B2 * 7/2017 Rohrbach ..... A44C 5/08
9,720,376 B2 * 8/2017 Tsushima ..... G04B 37/1486
9,768,538 B1 * 9/2017 Tulloch ..... H01R 31/06
9,798,356 B2 * 10/2017 Nakayama ..... G06F 1/163
9,891,665 B2 * 2/2018 Han ..... G06F 1/163
2001/0043514 A1 * 11/2001 Kita ..... A44C 5/0015 368/281
2006/0260842 A1 * 11/2006 Sim ..... G04G 17/083 174/562
2007/0064542 A1 * 3/2007 Fukushima ..... G04B 37/1486 368/282
2007/0279852 A1 * 12/2007 Daniel ..... A44C 5/0007 361/679.03
2008/0318636 A1 * 12/2008 Kim ..... G06F 1/163 455/566
2009/0086579 A1 4/2009 Clark
2009/0207701 A1 * 8/2009 Jacques ..... G04G 17/083 368/205
2011/0059771 A1 * 3/2011 Kondo ..... G06F 1/1616 455/556.2
2016/0037875 A1 * 2/2016 Rohrbach ..... G04B 37/1486 224/267
2016/0088880 A1 * 3/2016 Tulloch ..... H01R 31/06 439/37

* cited by examiner

WEARABLE DEVICE AND FUNCTIONAL MODULE THEREOF

FIELD OF THE INVENTION

The present invention relates to a wearable device, and more particularly to a wearable device with plural detachable functional modules.

BACKGROUND OF THE INVENTION

With increasing development of science and technology, various electronic devices are designed toward small size, light weightiness and easy portability. For example, a wearable device with the above benefits has been introduced into the market.

A wearable device such as a smart wristwatch usually comprises a watch core and a wristband. The watch core has a computing function. Since the demands of the consumers on the smart wristwatch are gradually increased, the watch core with only the computing function can't meet the user's requirement.

For solving the above drawbacks, plural functional modules with specified functions are installed on a single flexible circuit board of the wearable device. In addition, these functional modules are electrically connected with each other through the single flexible circuit board. Consequently, the wearable device can provide diversified functions. For example, Taiwanese Patent No. M485638 discloses a wearable device with plural functional modules. The plural functional modules are installed on a single flexible circuit board and electrically connected with each other through the flexible circuit board. In US Patent Publication No. US2007/0279852, plural functional modules with specified functions are installed on a single electrical membrane layer and electrically connected with each other through the single electrical membrane layer.

However, the conventional technology still has some drawbacks. For example, if a specified functional module or a single flexible circuit board (or a single electrical membrane layer) is damaged, the damaged component needs to be replaced with a new one. Under this circumstance, the maintenance cost is increased. Moreover, since the functional modules cannot be individually replaced according to the user's requirement, the utilization of the wearable device is limited.

SUMMARY OF THE INVENTION

An object of the present invention provides a wearable device. The wearable device comprises plural functional modules with different functions. The plural functional modules can be selectively combined with each other according to the user's requirements. Moreover, the plural functional modules can be combined as a wristband. Consequently, the functions provided by the wearable device are diversified. In addition, the wearable device is assembled and maintained more easily, and the maintenance cost is reduced.

In accordance with an aspect of the present invention, there is provided a wearable device. The wearable device includes a host and plural functional modules. The host includes a first housing and a controlling unit. The controlling unit is disposed within the first housing. Moreover, two ends of the controlling unit include a first electrical conduction part and a second electrical conduction part, respectively. Each of the plural functional modules is capable of detachable coupling with the host. Every two adjacent functional modules of the plural functional modules are capable of detachable coupling with each other. Each of the plural functional modules includes a second housing, a functional circuit unit and a connection unit. The functional circuit unit is accommodated within the second housing. Moreover, two ends of the functional circuit unit include a third electrical conduction part and a fourth electrical conduction part, respectively. The connection unit is used for connecting the host and the functional circuit unit or connecting the functional circuit unit and a functional circuit unit of the adjacent function module. The connection unit includes a flexible printed circuit board and a package structure. The flexible printed circuit board includes a first connection part and a second connection part. The first connection part is connected with the third electrical conduction part. The second connection part is exposed outside the second housing. The second connection part is detachably coupled and electrically connected with one of the first electrical conduction part of the host, the second electrical conduction part of the host and the fourth electrical conduction part of the adjacent function module. The flexible printed circuit board is partially covered by the package structure. The first connection part and the second connection part are exposed outside the package structure.

In accordance with another aspect of the present invention, there is provided a functional module. The functional module is capable of detachable coupling with a host or an adjacent functional module. The host includes a first housing and a controlling unit. The controlling unit is disposed within the first housing. A first electrical conduction part and a second electrical are respectively formed at two ends of the controlling unit. The functional module includes a second housing, a functional circuit unit and a connection unit. The functional circuit unit is accommodated within the second housing. Moreover, two ends of the functional circuit unit comprise a third electrical conduction part and a fourth electrical conduction part, respectively. The connection unit is used for connecting the host and the functional circuit unit or connecting the functional circuit unit with a functional circuit unit of the adjacent function module. The connection unit includes a flexible printed circuit board and a package structure. The flexible printed circuit board includes a first connection part and a second connection part. The first connection part is connected with the third electrical conduction part. The second connection part is exposed outside the second housing. The second connection part is detachably coupled and electrically connected with one of the first electrical conduction part of the host, the second electrical conduction part of the host and the fourth electrical conduction part of the adjacent function module. The flexible printed circuit board is partially covered by the package structure, and the first connection part and the second connection part are exposed outside package structure.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1:
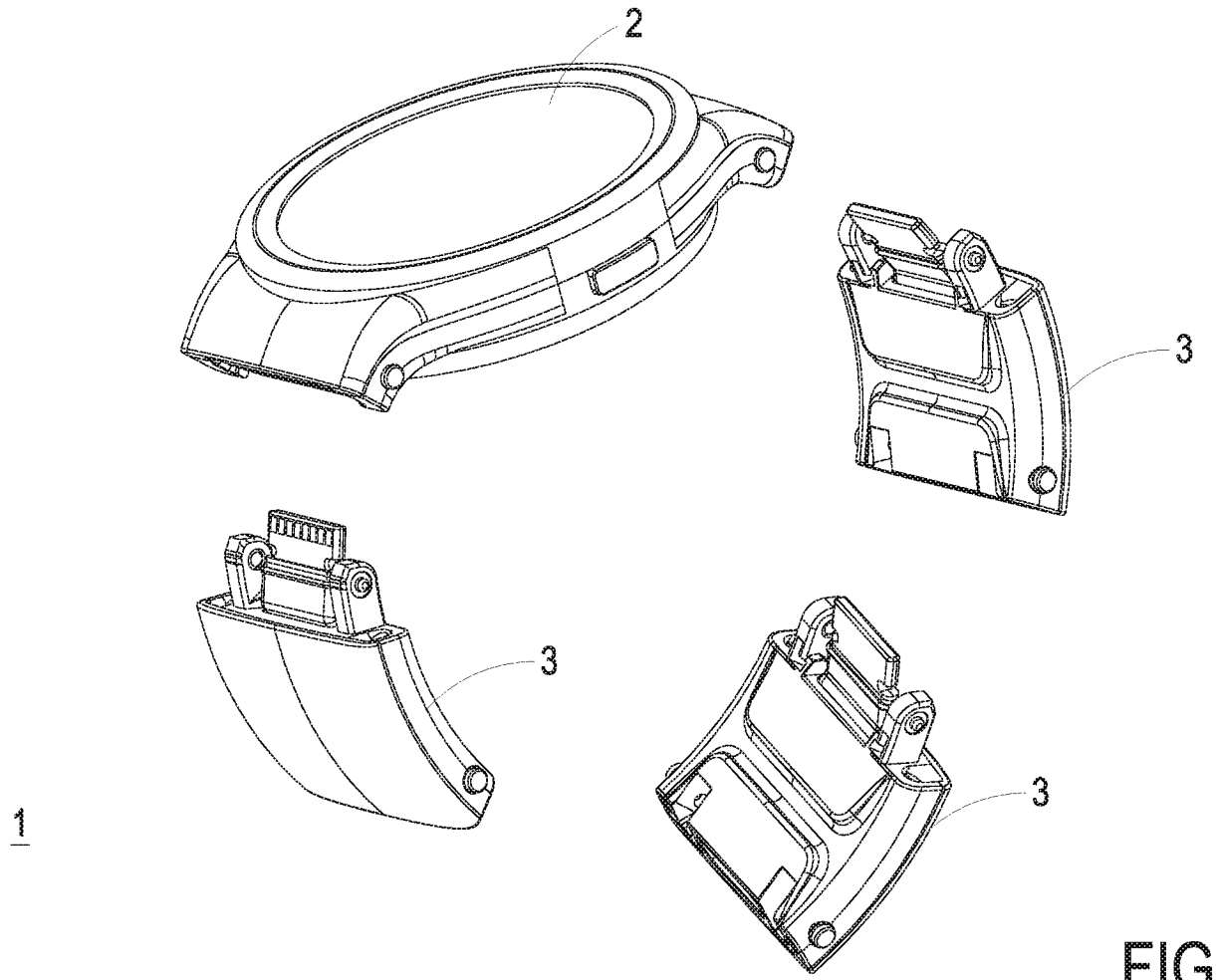
FIG. 1 is a schematic exploded view illustrating a wearable device according to an embodiment of the present invention.
Figure 2:
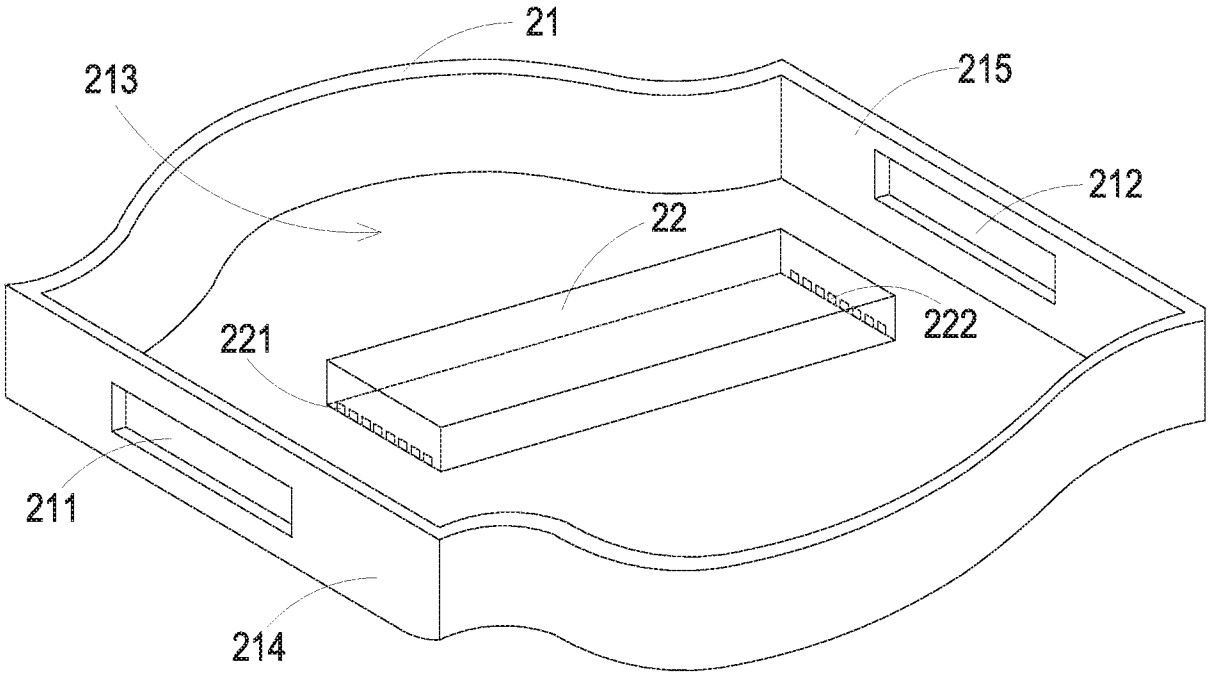
FIG. 2 is a schematic perspective view illustrating a host of the wearable device according to the embodiment of the present invention.
Figure 3A:
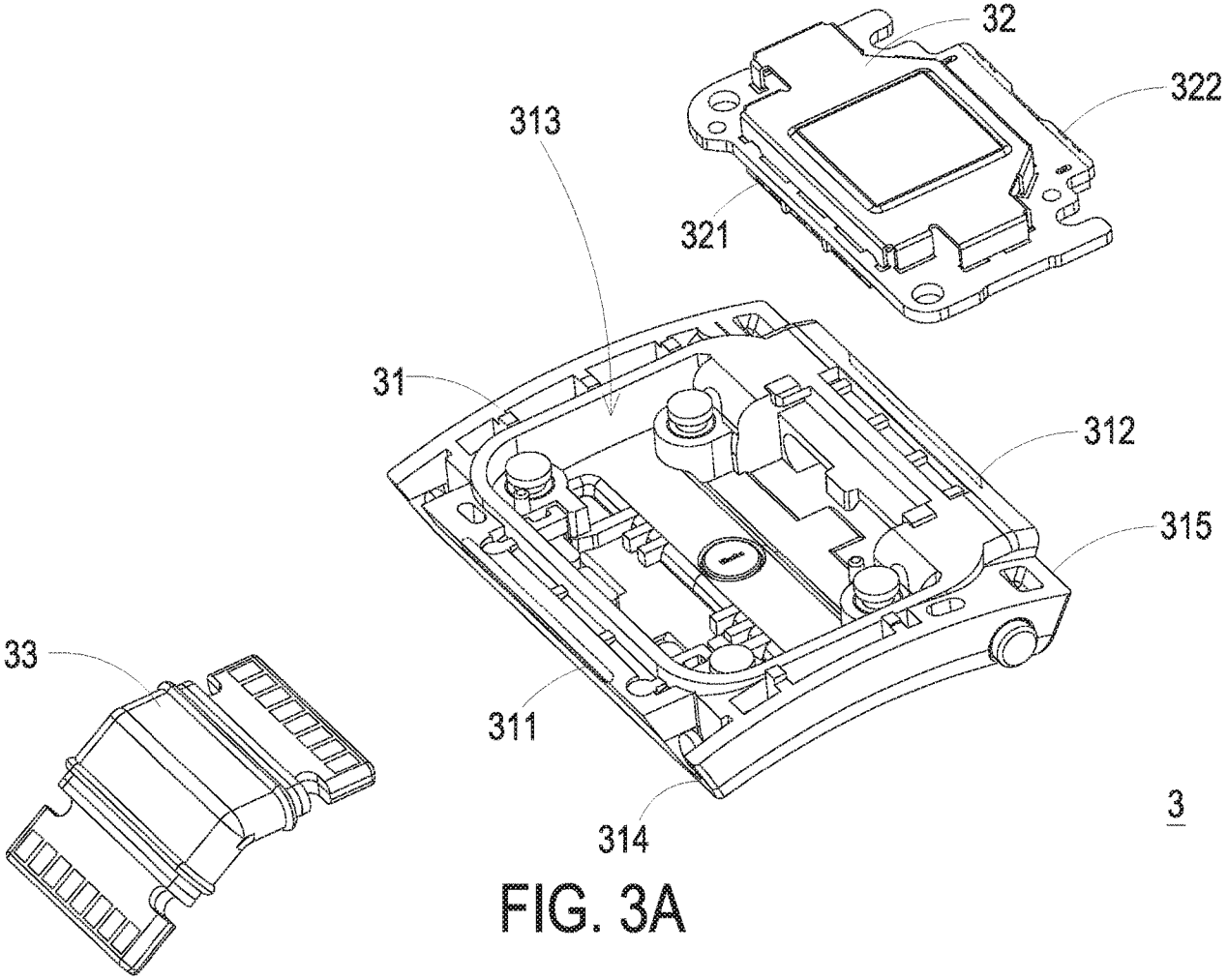
FIG. 3A is a schematic exploded view illustrating a functional module of the wearable device according to the embodiment of the present invention.
Figure 3B:
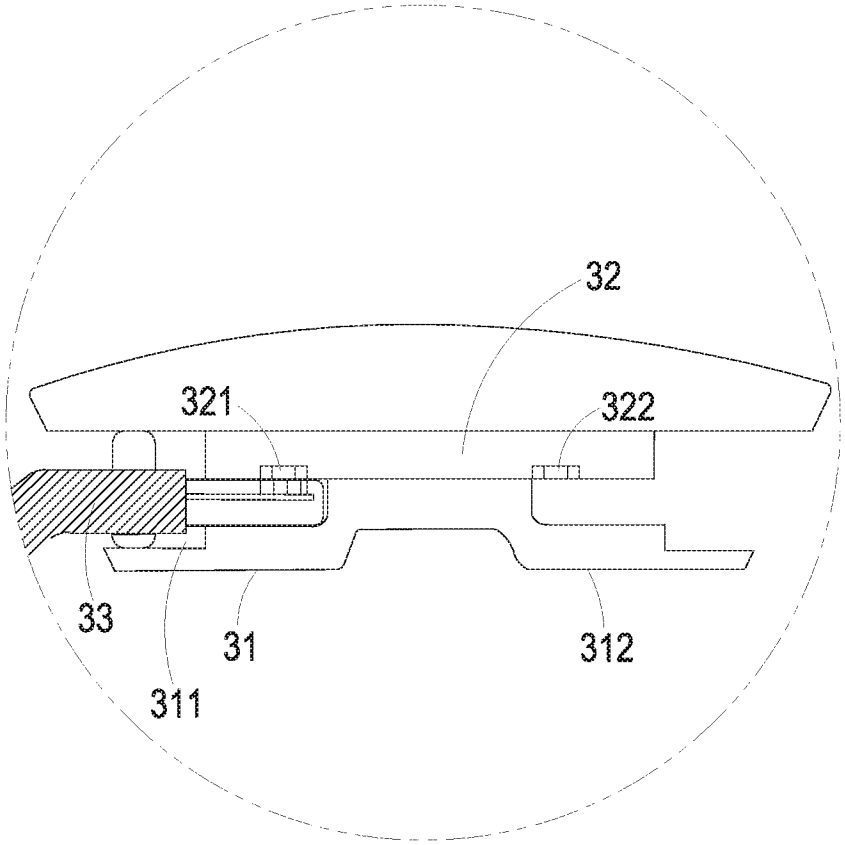
FIG. 3B is a schematic cross-sectional view illustrating a portion of the functional module of FIG. 3A.

FIG. 1 is a schematic exploded view illustrating a wearable device according to an embodiment of the present invention. FIG. 2 is a schematic perspective view illustrating a host of the wearable device according to the embodiment of the present invention. FIG. 3A is a schematic exploded view illustrating a functional module of the wearable device according to the embodiment of the present invention. FIG. 3B is a schematic cross-sectional view illustrating a portion of the functional module of FIG. 3A. Please refer to FIGS. 1, 2, 3A and 3B. An example of the wearable device includes but is not limited to a smart wristwatch. The wearable device 1 comprises a host 2 and plural functional modules 3. The host 2 is a watch core. The plural functional modules 3 are combined as a wristband. The host 2 comprises a first housing 21 and a controlling unit 22. The first housing 21 comprises a first opening 211, a second opening 212 and a first receiving space 213. The first opening 211 is formed in a first lateral wall 214 of the first housing 21. The second opening 212 is formed in a second lateral wall 215 of the first housing 21. The first lateral wall 214 and the second lateral wall 215 are opposed to each other. The first receiving space 213 is disposed within the first housing 21. Moreover, the first receiving space 213 is in communication with the first opening 211 and the second opening 212. The controlling unit 22 is disposed within the first receiving space 213. Moreover, the two ends of the controlling unit 22 comprise a first electrical conduction part 221 and a second electrical conduction part 222, respectively.

The functional module 3 comprises a second housing 31, a functional circuit unit 32 and a connection unit 33. The second housing 31 comprises a third opening 311, a fourth opening 312 and a second receiving space 313. The third opening 311 is formed in a third lateral wall 314 of the second housing 31. The fourth opening 312 is formed in a fourth lateral wall 315 of the second housing 31. The third lateral wall 314 and the fourth lateral wall 315 are opposed to each other. The second receiving space 313 is disposed within the second housing 31. Moreover, the second receiving space 313 is in communication with the third opening 311 and the fourth opening 312. The functional circuit unit 32 is accommodated within the second receiving space 313. Moreover, the two ends of the functional circuit unit 32 comprise a third electrical conduction part 321 and a fourth electrical conduction part 322, respectively. The third electrical conduction part 321 is located near the third opening 311. The fourth electrical conduction part 322 is located near the fourth opening 312. A first portion of the connection unit 33 is inserted in the second receiving space 313 through the third opening 311. A second portion of the connection unit 33 is exposed outside the second housing 31. Through the connection unit 33, the host 2 and the functional circuit unit 32 are electrically connected with each other or the functional circuit unit 32 and an adjacent functional circuit unit 32 are electrically connected with each other. For connecting the functional module 3 with the host 2, the second portion of the connection unit 33 is inserted in the first receiving space 213 of the host 2 through the first opening 211 or the second opening 212. For connecting the functional module 3 with an adjacent functional module 3, the second portion of the connection unit 33 is inserted in the second receiving space 313 of the adjacent functional module 3 through the fourth opening 312 of the adjacent functional module 3.

Figure 4:
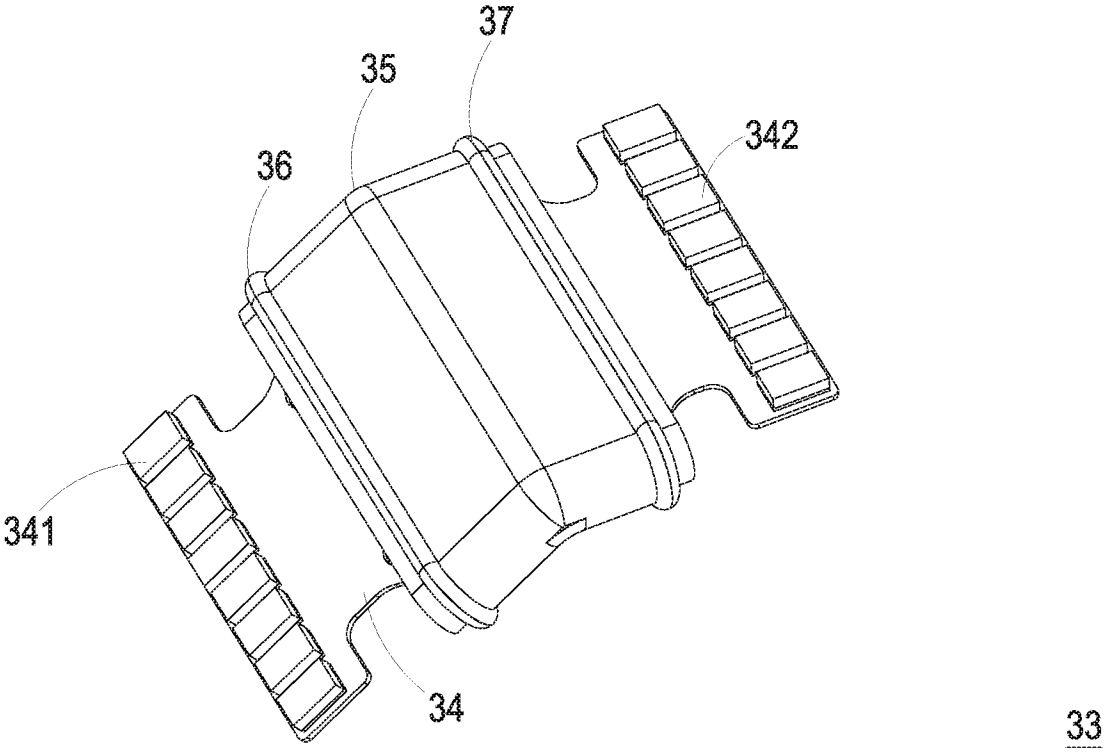
FIG. 4 is a schematic perspective view illustrating the connection unit of the functional module of FIG. 3A.

FIG. 4 is a schematic perspective view illustrating the connection unit of the functional module of FIG. 3A. As shown in FIG. 4, the connection unit 33 comprises a flexible printed circuit board 34, a package structure 35, a first waterproof part 36 and a second waterproof part 37. The flexible printed circuit board 34 comprises a first connection part 341 and a second connection part 342. The first connection part 341 is detachably coupled with the third electrical conduction part 321 of the functional circuit unit 32. After the first connection part 341 is coupled with the third electrical conduction part 321, the electric connection between the first connection part 341 and the third electrical conduction part 321 is established. In case that the second connection part 342 is coupled with the first electrical conduction part 221 or the second electrical conduction part 222 of the host 2, the functional module 3 and the host 2 are combined together. In case that the second connection part 342 is connected with the fourth electrical conduction part 322 of an adjacent functional module 3, the functional module 3 and the adjacent functional module 3 are combined together. The flexible printed circuit board 34 is partially covered by the package structure 35, wherein the first connection part 341 and the second connection part 342 are exposed.

The first waterproof part 36 is protruded from a first edge of the package structure 35 and located near the first connection part 341. The first waterproof part 36 is inserted in the third opening 311 to close the third opening 311. The second waterproof part 37 is protruded from a second edge of the package structure 35 and located near the second connection part 342. In case that the functional module 3 and the host 2 are combined together, the second waterproof part 37 is inserted in the first opening 211 or the second opening 212 of the host 2 to close the first opening 211 or the second opening 212. In case that the functional module 3 and the adjacent functional module 3 are combined together, the second waterproof part 37 is inserted in the fourth opening 312 of the adjacent functional module 3 to close the fourth opening 312.

Figure 5:
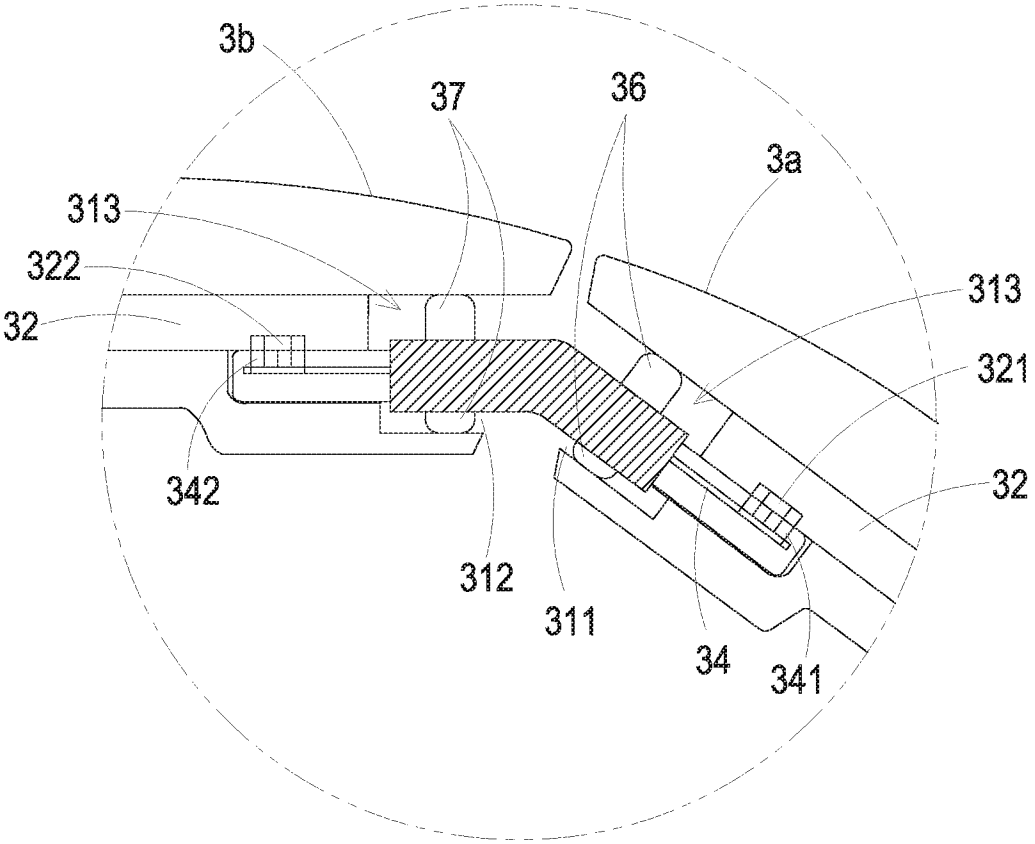
FIG. 5 is a schematic cross-sectional view illustrating the connection between two adjacent functional modules of the wearable device according to the embodiment of the present invention.

FIG. 5 is a schematic cross-sectional view illustrating the connection between two adjacent functional modules of the wearable device according to the embodiment of the present invention. In FIG. 5, a first functional module 3*a* and a second functional module 3*b* are shown. When the first functional module 3*a* and the second functional module 3*b* are combined together, the first connection part 341 of the first functional module 3*a* is coupled with and electrically connected with the third electrical conduction part 321 of the first functional module 3*a*. The first waterproof part 36 of the first functional module 3*a* is inserted in the third opening 311 of the first functional module 3*a*. Especially, the first waterproof part 36 is interference-fitted into the third opening 311 to close the third opening 311. The second connection part 342 of the first functional module 3*a* is inserted in the second receiving space 313 of the second functional module 3*b* through the fourth opening 312 of the second functional module 3*b*. The second connection part 342 of the first functional module 3*a* is coupled with and electrically connected with the fourth electrical conduction part 322 of the second functional module 3*b*. The second waterproof part 37 of the first functional module 3*a* is inserted in the fourth opening 312 of the second functional module 3*b*. Especially, the second waterproof part 37 is interference-fitted into the fourth opening 312 to close the fourth opening 312. Consequently, the functional circuit unit 32 of the first functional module 3*a* and the functional circuit unit 32 of the second functional module 3*b* are in communication with each other through the third electrical conduction part 321 of the first functional module 3*a*, the first connection part 341 of the first functional module 3*a*, the flexible printed circuit board 34 of the first functional module 3*a*, the second connection part 342 of the first functional module 3*a* and the fourth electrical conduction part 322 of the second functional module 3*b*. Under this circumstance, electronic signals can be transmitted through these components. The connection between the functional module 3 and the host 2 is similar to the connection between the first functional module 3*a* and the second functional module 3*b*, and is not redundantly described herein.

As mentioned above, every two adjacent functional modules 3 or the host 2 and the functional module 3 are detachably coupled with each other through the connection unit 33. Consequently, each functional module can be replaced with a new one, and the arranging sequence of the functional modules can be changed according to the practical requirements. Consequently, the user can enjoy different functions more flexibly. The connection unit 33 further comprises the first waterproof part 36 and the second waterproof part 37. When the host 2 and the plural functional modules 3 are combined together, the corresponding openings are closed by the first waterproof part 36 and the second waterproof part 37. Since the foreign moisture cannot enter the inner portion of the host 2 or the functional module 3, the electronic components within the host 2 or the functional module 3 are not damaged by the foreign moisture.

Figure 6:
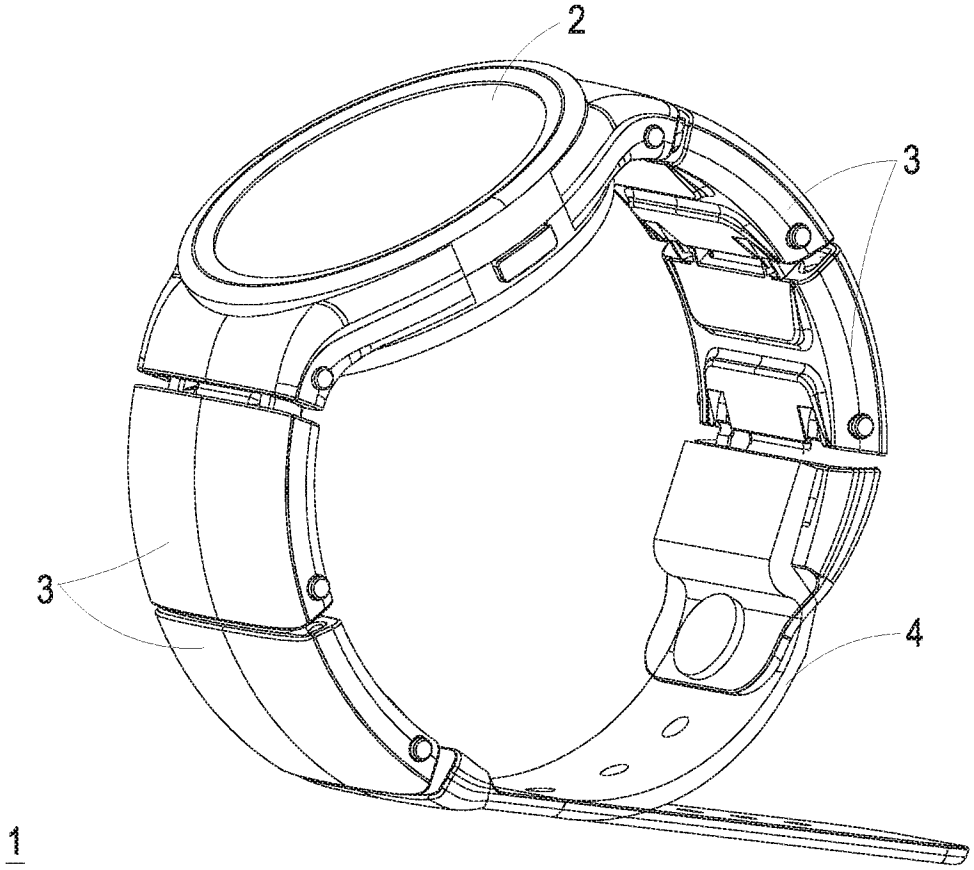
FIG. 6 is a schematic assembled view of the wearable device according to the embodiment of the present invention.

FIG. 6 is a schematic assembled view of the wearable device according to the embodiment of the present invention. As shown in FIG. 6, the wearable device 1 further comprises a fastener 4. The two ends of the fastener 4 are coupled with the corresponding functional modules 3. Consequently, a wristband is formed. The wristband can facilitate the user to wear the wearable device 1. In another embodiment, one end of the fastener 4 is coupled with the host 2, and the other end of the fastener 4 is coupled with the corresponding functional module 3. In this embodiment, the fastener is a wristband fastener.

Moreover, due to the engagement between first engaging structures and corresponding second engaging structures, the host 2 and the corresponding functional module 3 are combined with each other, every two adjacent functional modules 3 are combined together, the host 2 and the fastener 4 are combined together, or the functional module 3 and the fastener 4 are combined together.

Figure 7:
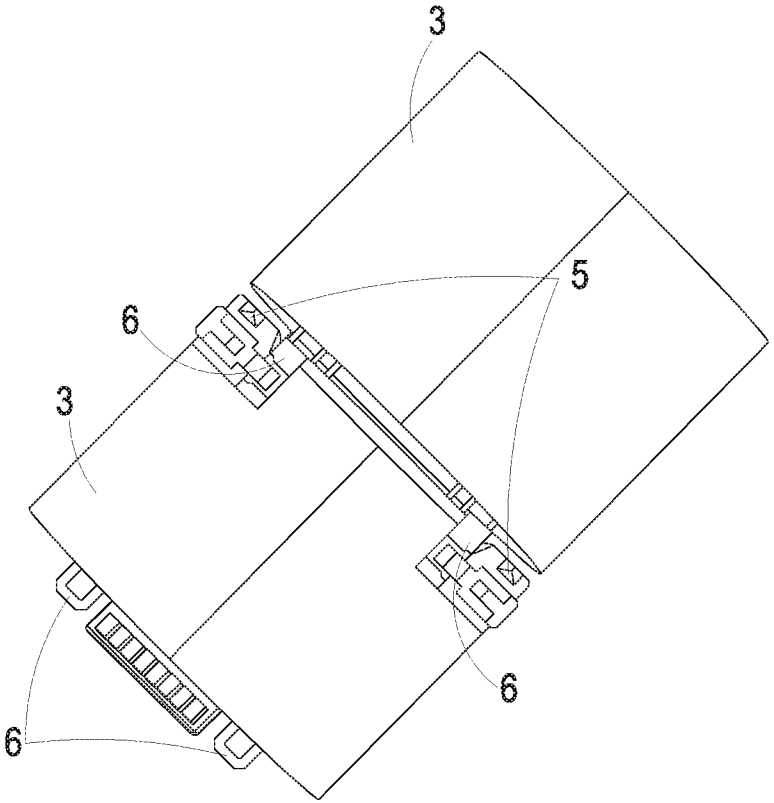
FIG. 7 is a schematic top view illustrating the connection of two functional modules through first engaging structures and corresponding second engaging structures.
Figure 8:
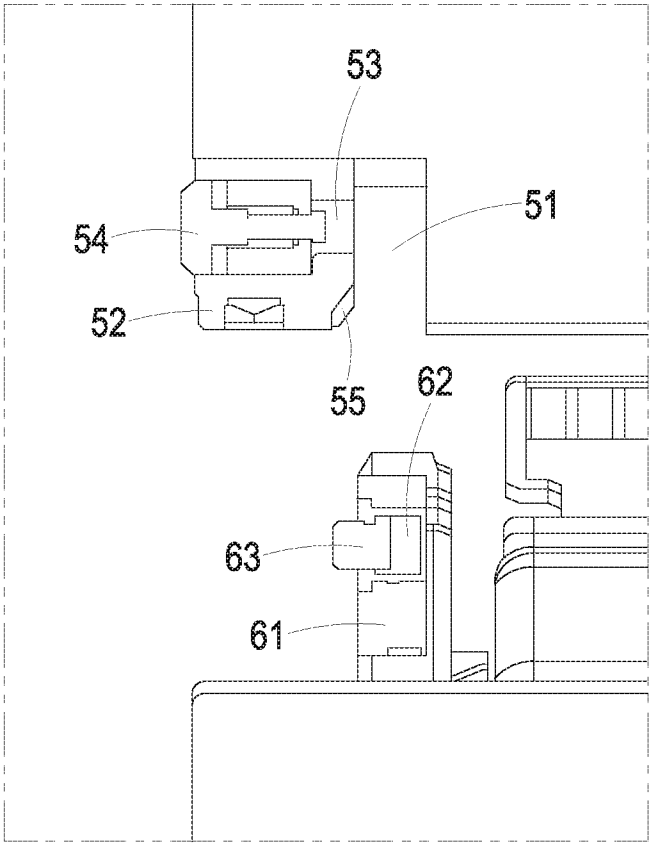
FIG. 8 is a schematic enlarged fragmentary side view illustrating the relationship between the first engaging structure and the second engaging structure of FIG. 7.

FIG. 7 is a schematic top view illustrating the connection of two functional modules through first engaging structures and corresponding second engaging structures. FIG. 8 is a schematic enlarged fragmentary side view illustrating the relationship between the first engaging structure and the second engaging structure of FIG. 7. Please refer to FIGS. 1-8. The wearable device 1 comprises plural first engaging structures 5 and plural second engaging structures 6. The plural first engaging structures 5 are disposed on the first lateral wall 214 of the host 2, the second lateral wall 215 of the host 2 and the fourth lateral wall 315 of the functional module 3. Each first engaging structure 5 comprises a recess 51 and a first bulge 52 close to the recess 51. Moreover, the first bulge 52 further comprises a channel 53 and a pressing post 54. The channel 53 is in communication with the recess 51. The pressing post 54 is partially accommodated within the channel 53 and partially protruded out of the channel 53.

The plural second engaging structures 6 are disposed on the third lateral wall 314 of the functional module 3 and located beside two edge of the third opening 311 and the two ends of the fastener 4. The second engaging structure 6 comprises a second bulge 61. The second bulge 61 comprises a groove 62 and an elastic sheet 63. The elastic sheet 63 is partially accommodated within the groove 62 and partially protruded out of the groove 62.

The first engaging structures 5 are engaged with the corresponding second engaging structures 6. A process of resulting in the engagement between the first engaging structures 5 and the second engaging structures 6 will be described as follows. Firstly, the second bulge 61 of the second engaging structure 6 is gradually received within the recess 51 of the corresponding first engaging structure 5. At the same time, the elastic sheet 63 of the second bulge 61 is pushed by the inner surface of the recess 51 and received in the groove 62. When the tip of the second bulge 61 is contacted with a bottom of the recess 51, the groove 62 of the second bulge 61 is aligned with and in communication with the channel 53 of the first bulge 52. In response to the elastic restoring force of the elastic sheet 63, the elastic sheet 63 is inserted into the channel 53 of the first bulge 52. Consequently, the first engaging structure 5 and the second engaging structure 6 are engaged with each other.

A process of detaching the first engaging structure 5 from the second engaging structure 6 will be described as follows. Firstly, an external force is applied to the pressing post 54. Consequently, the pressing post 54 is moved within the channel 53 to push the elastic sheet 63. When the elastic sheet 63 is pushed out of the channel 53 and completely received in the groove 62, the first engaging structure 5 and the second engaging structure 6 are disengaged from each other.

Optionally, the first bulge 52 further comprises a guiding slant 55. The guiding slant 55 is located beside the inner wall of the recess 51. While the second bulge 61 is inserted in the recess 51, the elastic sheet 63 is moved along the guiding slant 55. Consequently, the elastic sheet 63 can be received in the groove 62 more easily.

The host 2, the plural functional module 3 and the fastener 4 can be combined together securely due to the engagement between the first engaging structures 5 and the second engaging structures 6.

Figure 9:
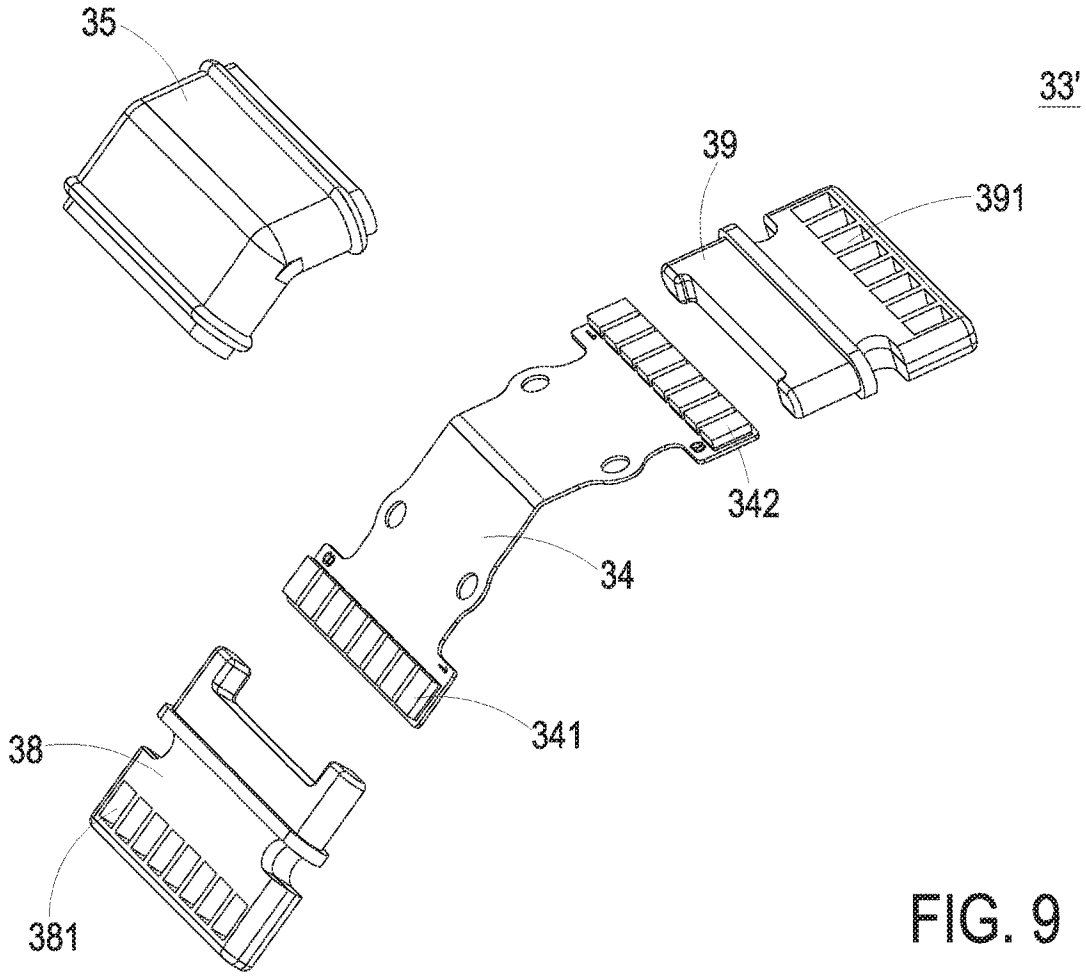
FIG. 9 is a schematic exploded view illustrating another exemplary connection unit used in the wearable device of the present invention.

FIG. 9 is a schematic exploded view illustrating another exemplary connection unit used in the wearable device of the present invention. In comparison with FIG. 4, the connection unit 33' of this embodiment further comprises a first covering part 38 and a second covering part 39. The first connection part 341 and the second connection part 342 of the flexible printed circuit board 34 are covered by the first covering part 38 and the second covering part 39, respectively. The first covering part 38 comprises a fifth electrical conduction part 381. The fifth electrical conduction part 381 runs through from an inner surface to an outer surface of the first covering part 38. Moreover, the fifth electrical conduction part 381 is contacted and electrically connected with the first connection part 341. The second covering part 39 comprises a sixth electrical conduction part 391. The sixth electrical conduction part 391 runs through from an inner surface to an outer surface of the second covering part 39. Moreover, the sixth electrical conduction part 391 is contacted and electrically connected with the second connection part 342.

In an embodiment, the fifth electrical conduction part 381 is contacted and electrically connected with the third electrical conduction part 321 of the functional circuit unit 32. In case that the sixth electrical conduction part 391 is contacted and electrically connected with the first electrical conduction part 221 or the second electrical conduction part 222 of the host 2, the functional module 3 and the host 2 are combined together. In case that the sixth electrical conduction part 391 is contacted and electrically connected with the fourth electrical conduction part 322 of an adjacent functional module, the functional module 3 and the adjacent functional module are combined together.

In an embodiment, the first covering part 38 and the second covering part 39 are made of insulation material. Since the first connection part 341 and the second connection part 342 of the flexible printed circuit board 34 are covered by the first covering part 38 and the second covering part 39, the first connection part 341 and the second connection part 342 are protected from damage.

In accordance with the present invention, the functional circuit unit 32 can provide diversified functions. For example, the functional circuit unit 32 is a power supply unit, a memory unit, a video playing unit or a wireless signal transceiver. Moreover, the first connection part 341 and the second connection part 342 are made of electrically conductive material such as copper. Moreover, first connection part 341 and the second connection part 342 are disposed on the corresponding contact regions of the flexible printed circuit board 34 by a surface-mount technology (SMT). The first connection part 341 and the second connection part 342 are covered by the first covering part 38 and the second covering part 39 by an in-mold decoration process. The package structure 35 is made of a soft encapsulation material such as rubber. Moreover, the package structure 35 and the flexible printed circuit board 34 are combined together by a rubber-co-mold process. Since the package structure 35 is made of the soft encapsulation material, the bending extent of the combination of the functional module 3 and the host 2 or the bending extent of the combination of the two adjacent functional modules 3 can be increased. Consequently, the comfortability of wearing the wearable device is enhanced.

From the above descriptions, the present invention provides a wearable device. The wearable device comprises plural functional modules with different functions. The plural functional modules can be selectively combined with each other according to the user's requirements. Moreover, the plural functional modules can be combined as a wristband. Consequently, the functions provided by the wearable device are diversified. In addition, the wearable device is assembled and maintained more easily, and the maintenance cost is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A wearable device, comprising:

a host comprising a first housing and a controlling unit, wherein the first housing comprises a first opening, a second opening and a first receiving space, wherein the first opening is formed in a first lateral wall of the first housing, the second opening is formed in a second lateral wall of the first housing, the first lateral wall and the second lateral wall are opposed to each other, the first receiving space is disposed within the first housing, the first receiving space is in communication with the first opening and the second opening, wherein the controlling unit is disposed within the first receiving space of the first housing, and two ends of the controlling unit comprise a first electrical conduction part and a second electrical conduction part, respectively; and plural functional modules, wherein each of the plural functional modules is capable of detachable coupling with the host, and every two adjacent functional modules of the plural functional modules are capable of detachable coupling with each other, wherein each of the plural functional modules comprises:

a second housing comprising a third opening, a fourth opening and a second receiving space, wherein the third opening is formed in a third lateral wall of the second housing, a fourth opening is formed in a fourth lateral wall of the second housing, the third lateral wall and the fourth lateral wall are opposed to each other, the second receiving space is disposed within the second housing, and the second receiving space is in communication with the third opening and the fourth opening;

a functional circuit unit accommodated within the second receiving space of the second housing, wherein two ends of the functional circuit unit comprise a third electrical conduction part and a fourth electrical conduction part, respectively, and the third electrical conduction part of the functional circuit unit is located near the third opening, and the fourth electrical conduction part of the functional circuit unit is located near the fourth opening; and a connection unit for connecting the host and the functional circuit unit or connecting the functional circuit unit and a functional circuit unit of an adjacent function module, wherein a first portion of the connection unit is inserted in the second receiving space through the third opening, and a second portion of the connection unit is detachably inserted in the first opening of the host, the second opening of the host or the fourth opening of the adjacent functional module, wherein the connection unit comprises a flexible printed circuit board, a package structure, a first waterproof part and a second waterproof part, and the flexible printed circuit board comprises a first connection part and a second connection part, wherein the first connection part is connected with the third electrical conduction part, the second connection part is exposed outside the second housing, and the second connection part is detachably coupled and electrically connected with one of the first electrical conduction part of the host, the second electrical conduction part of the host and the fourth electrical conduction part of the adjacent function module, wherein the flexible printed circuit board is partially covered by the package structure, and the first connection part and the second connection part are exposed outside the package structure, wherein the first waterproof part is protruded from a first edge of the package structure and located near the first connection part, wherein the first waterproof part is inserted in the third opening to close the third opening, wherein the second waterproof part is protruded from a second edge of the package structure and located near the second connection part, wherein the second waterproof part is selectively inserted in the first opening of the host, the second opening of the host or the fourth opening of the adjacent functional module to close the first opening, the second opening or the fourth opening.

2. The wearable device according to claim 1, wherein the connection unit further comprises:

a first covering part comprising a fifth electrical conduction part, wherein the fifth electrical conduction part runs through from an inner surface to an outer surface of the first covering part, and the fifth electrical conduction part is contacted and electrically connected with the first connection part; and a second covering part comprising a sixth electrical conduction part, wherein the sixth electrical conduction part runs through from an inner surface to an outer surface of the second covering part, and the sixth electrical conduction part is contacted and electrically connected with the second connection part, wherein the fifth electrical conduction part is contacted and electrically connected with the third electrical conduction part, and the sixth electrical conduction part is detachably coupled and electrically connected with the first electrical conduction part of the host, the second electrical conduction part of the host, or the fourth electrical conduction part of the adjacent function module.

3. The wearable device according to claim 1, further comprising:

plural first engaging structures disposed on the host and the plural functional modules; and plural second engaging structures disposed on the plural functional modules, wherein when the second engaging structure of a specified functional module is engaged with the corresponding first engaging structure of the host, the specified functional module is coupled with the host, wherein when the second engaging structure of the specified functional module is engaged with the corresponding first engaging structure of the adjacent functional module, the specified functional module is coupled with the adjacent functional module.

4. The wearable device according to claim 3, wherein each of the plural first engaging structures comprises a recess and a first bulge, and each of the plural second engaging structures comprises a second bulge, wherein the first bulge is located beside the recess and comprises a channel and a pressing post, the channel is in communication with the recess, and the pressing post is partially accommodated within the channel and partially protruded out of the channel, wherein the second bulge comprises a groove and an elastic sheet, and the elastic sheet is partially accommodated within the groove and partially protruded out of the groove, wherein when the second bulge of the second engaging structure is received in the recess and a tip of the second bulge is contacted with a bottom of the recess, the elastic sheet of the second engaging structure is partially inserted in the channel of the first engaging structure.

5. The wearable device according to claim 4, wherein when an external force is applied to the pressing post, the pressing post is moved within the channel to push the elastic sheet, so that the elastic sheet received in the groove.

6. The wearable device according to claim 4, wherein the first bulge further comprises a guiding slant, and the guiding slant is located beside an inner wall of the recess, wherein while the second bulge is inserted in the recess, the elastic sheet is moved along the guiding slant.

7. The wearable device according to claim 1, further comprising a fastener, wherein two ends of the fastener are respectively coupled with the host and the corresponding functional module, or two ends of the fastener are respectively coupled with the corresponding functional modules.

8. The wearable device according to claim 1, wherein the wearable device is a smart wristwatch, the host is a watch core, and the plural functional modules are combined as a wristband.

9. A functional module capable of detachable coupling with a host comprising a first opening and a second opening or an adjacent functional module, the functional module comprising:

a second housing comprising a third opening, a fourth opening and a second receiving space, wherein the third opening is formed in a third lateral wall of the second housing, a fourth opening is formed in a fourth lateral wall of the second housing, the third lateral wall and the fourth lateral wall are opposed to each other, the second receiving space is disposed within the second housing, and the second receiving space is in communication with the third opening and the fourth opening;

a functional circuit unit accommodated within the second receiving space of the second housing, wherein two ends of the functional circuit unit comprise a third electrical conduction part and a fourth electrical conduction part, respectively, and the third electrical conduction part of the functional circuit unit is located near the third opening, and the fourth electrical conduction part of the functional circuit unit is located near the fourth opening; and a connection unit for connecting the host and the functional circuit unit or connecting the functional circuit unit with a functional circuit unit of the adjacent function module, wherein a first portion of the connection unit is inserted in the second receiving space through the third opening, and a second portion of the connection unit is detachably inserted in the first opening of the host, the second opening of the host or the fourth opening of the adjacent functional module, wherein the connection unit comprises a flexible printed circuit board, a package structure, a first waterproof part and a second waterproof part, and the flexible printed circuit board comprises a first connection part and a second connection part, wherein the first connection part is connected with the third electrical conduction part, the second connection part is exposed outside the second housing, and the second connection part is detachably coupled and electrically connected with one of the host and the fourth electrical conduction part of the adjacent function module, wherein the flexible printed circuit board is partially covered by the package structure, and the first connection part and the second connection part are exposed outside package structure, wherein the first waterproof part is protruded from a first edge of the package structure and located near the first connection part, wherein the first waterproof part is inserted in the third opening to close the third opening, wherein the second waterproof part is protruded from a second edge of the package structure and located near the second connection part, wherein the second waterproof part is selectively inserted in the first opening of the host, the second opening of the host or the fourth opening of the adjacent functional module to close the first opening, the second opening or the fourth opening.

* * * * *